US005244207A

United States Patent [19]

Laatikainen

[11] Patent Number: 5,244,207

[45] Date of Patent: Sep. 14, 1993

[54] GAMING DEVICE

[75] Inventor: Jouko Laatikainen, Helsinki, Finland

[73] Assignee: Raha-automaattiyhdystys, Espoo, Finland

[21] Appl. No.: 854,608

[22] PCT Filed: Jan. 2, 1991

[86] PCT No.: PCT/FI91/00004

§ 371 Date: Jun. 10, 1992

§ 102(e) Date: Jun. 10, 1992

[87] PCT Pub. No.: WO91/10215

PCT Pub. Date: Jul. 11, 1991

[30] Foreign Application Priority Data

Jan. 5, 1990 [FI] Finland ..... 900062

[51] Int. Cl.[5] ..... A63F 5/00; G07F 17/34

[52] U.S. Cl. ..... 273/138 A; 453/32

[58] Field of Search ..... 273/138 A; 453/32, 52

[56] References Cited

U.S. PATENT DOCUMENTS

| | | | |
|---|---|---|---|
| 4,041,280 | 8/1977 | Ohsako et al. | 453/32 X |
| 4,257,435 | 3/1981 | Tanaka et al. | 453/32 X |
| 4,287,900 | 9/1981 | Kokubo et al. | 453/52 |
| 4,429,407 | 1/1984 | Furuya | 453/32 X |
| 4,491,140 | 1/1985 | Eglise et al. | 453/32 X |
| 4,753,625 | 6/1988 | Okada | 453/32 |
| 5,010,995 | 4/1991 | Okada | 273/138 A X |

FOREIGN PATENT DOCUMENTS

| | | |
|---|---|---|
| 3230788 | 2/1984 | Fed. Rep. of Germany . |
| 1414898 | 11/1975 | United Kingdom . |

*Primary Examiner*—William H. Grieb

*Attorney, Agent, or Firm*—Nixon & Vanderhye

[57] ABSTRACT

The invention relates to a gaming device comprising a gaming machine, a payout machinery controlled by the gaming machine and driven by a direct voltage motor, the operating time of which machinery proportional to the size of the payouts is controlled by a control signal (4) produced by the gaming machine, and means for feeding the motor with drive current depending on the control signal (4) of the gaming machine. To improve the reliability of the operation of the payout machinery, the control signal (4) is a digital code of at least 2 bits and the means for feeding the motor with current comprise a control register (5), a shift register (7), and a logic (8) for time control to reset the shift register output (Q) to zero after the control time set in the logic (8) for time control has expired, whereby the shift register (7) output (Q) comprises the drive current for the motor of the payout machinery either directly or through a current amplifier (11).

2 Claims, 1 Drawing Sheet

GAMING DEVICE

Figure 1:
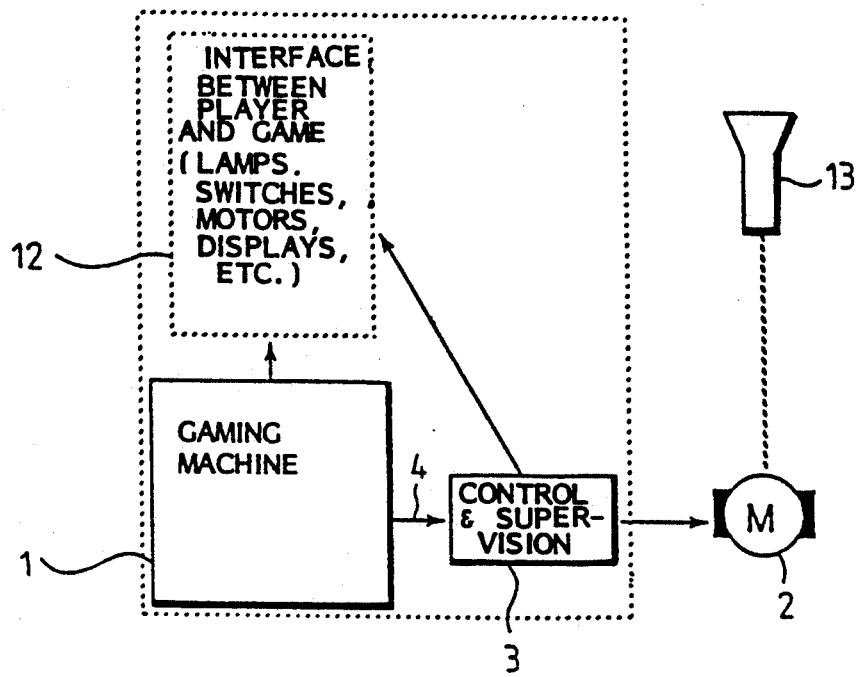

This invention relates to a gaming device comprising a gaming machine, a payout machinery controlled by the gaming machine and driven by a direct voltage motor, the operating time of which machinery proportional to the size of the payouts is controlled by a control signal produced by the gaming machine, and means for feeding the motor with drive current depending on the control signal of the gaming machine.

In conventional gaming devices of the type described above, the motor of the payout machinery is controlled by a signal given by the gaming machine, which signal feeds the motor of the payout machinery directly with drive current through a suitable switch, e.g. a transistor. This way of controlling the payout machinery is relatively sensitive to external disturbance. Such disturbance can occur for instance by electromagnetic pulses, by spraying chemicals or by changing the drive current. The intention is then either to make the motor of the payout machinery start without cause or to prevent a correct payout operation from ending.

The object of the present invention is to provide a gaming device, in which the operation of the payout machinery is substantially more reliable than before and which is not to the extent sensitive to external disturbance as the prior art gaming devices.

This is achieved by means of the gaming device of the invention, which is characterized in that the control signal is a digital code of at least 2 bits and the means for feeding the motor with current comprise a control register with an input receiving the control signal and with an output, the state of which depends on the value of the control signal, a shift register with an output, a reset input and a data input receiving the output of the control register, and a logic for time control with a starting input connected to the control register and with an output connected to the reset input of the shift register to reset the shift register output to zero after the control time set in the logic for time control has expired, whereby the shift register output comprises the drive current for the motor of the payout machinery either directly or through a current amplifier.

By substituting the conventional signal of on/off type given by the gaming machine earlier for a digitally coded control code, it is possible to substantially eliminate the possibility that the gaming machine unintentionally or as a result of a possible disturbance would give a control code for starting a payout. By forming the very circuit feeding the motor of the payout machinery with drive current in such a way that, firstly, it only reacts to a correct control code and secondly, it controls its own function as per time by means of a logic for time control, the possibility is substantially eliminated that stopping the payout for some reason would be prevented.

To reduce the possibilities of external disturbance further, the procedure according to the invention is that the control register, the shift register and the logic for time control are arranged in the same integrated circuit, which substantially eliminates the possibility of preventing the operation of the logic for time control and makes an external disturbance of also other mutual connections between these parts impossible.

Figure 2:
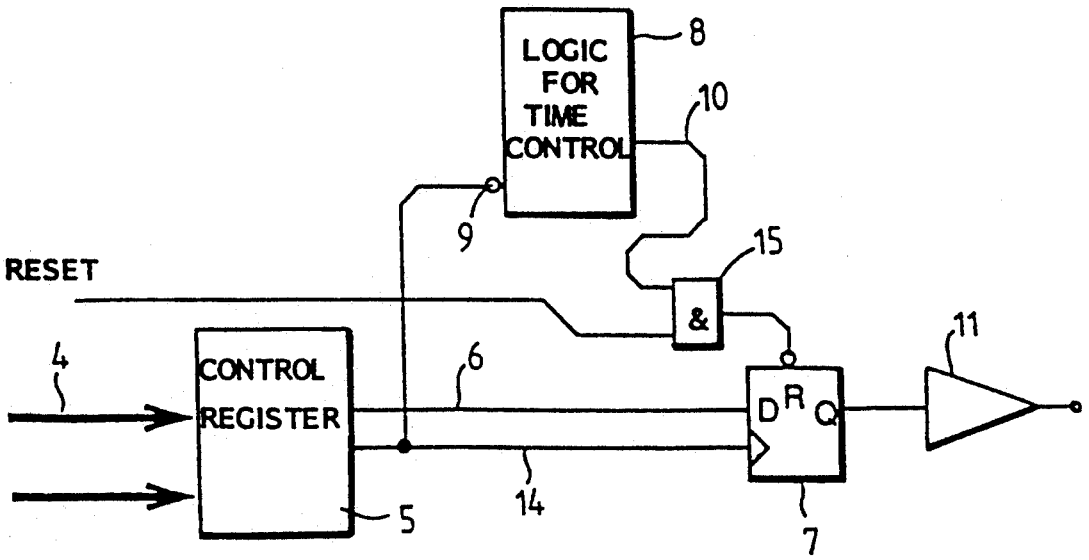

In the following, the gaming device of the invention is described in greater detail referring to the enclosed drawing, in which FIG. 1 shows the main structural parts of a gaming device of the invention in the form of a block diagram and FIG. 2 shows a basic block diagram of a control and supervisory circuit system of a payout machinery in the gaming device of the invention.

FIG. 1 shows a gaming device according to the invention, comprising a gaming machine 1 usually including a micro processor, interface 12 between the player and the gaming device including lamps, switches, motors, displays and the like, by means of which the player uses the gaming device, and a control and supervisory section 3, which by means of the gaming machine 1 controls a payout machinery 2. The payout machinery 2 receives counters, coins or the like from a coin receiving section 13. At the beginning of a game, the player conventionally feeds a gaming fee into this money receiving section 13, from which the coins or the like move to the payout machinery 2, delivering the possible payouts to the player under the control of the gaming machine 1. In the gaming device according to the invention, a control output 4 of the gaming machine 1 to the control and supervisory section is a digital code of at least 2 bits. In practice, it can be for instance a code of eight bits, which then can get 256 different states. Only one of these states makes the control and supervisory section 3 start the payout machinery 2. In this way, a starting of the payout machinery unintentionally or through disturbance is substantially eliminated.

FIG. 2 shows a basic block diagram of the control and supervisory section 3 in greater detail. This control and supervisory section comprises a control register 5, a logic 8 for time control and a shift register 7 operating under the control thereof. The input of the control register 5 receives the control code 4 given by the gaming machine 1. It also receives signals for choosing the register, which signals bring this control register into a state for receiving the code 4. Depending on the content of the digital code 4, the output 6 of the control register 5 either has state "0" or state "1". State "1" then means a payout. At the same time when the digital code 4 is entered into the control register 5 and the output 6 of the control register 5 therefore shifts to state "0" or state "1", a clock signal is produced in an output 14 of the control register 5. This clock signal is connected to a starting input 9 of the logic 8 for time control and also t the clock input of the shift register 7. Each entry into the control register starts the logic for time control irrespective of whether the output of the control register is changed or not. In the shift register 7 the clock signal makes the signal in its input D shift to its output Q. The state of this output Q is preserved till a new digital word is entered into the control register 5 or the control time of the logic 8 for time control expires. In the latter case, a signal is produced in an output 10 of the logic 8 for time control, which signal makes an AND gate 15, one input of which is a RESET signal, feed a signal resetting the output Q of the shift register to zero to an input R of the shift register 7. Thus the logic for time control unevitably interrupts the payout after a desired period of time control. Such a time control period can be for instance 0,5 seconds. The payout machinery operates in such a way that it feeds out one coin or the like during one payout operation in practice. Moreover, to the output Q of the shift register 7 is connected a current amplifier 11, which can be necessary in order to provide a sufficient drive current for the motor M of the payout machinery 2.

In the gaming device of the invention, the control register 5, the logic 8 for time control and the shift register 7 shown in FIG. 2 are preferably integrated to the same integrated circuit. In this way the connections between its different parts are not subjected to external disturbance. This also guarantees that the operation of the logic for time control cannot be prevented from outside.

The gaming device of the invention has above been described by means of one exemplifying embodiment only and it is to be understood that the idea of the invention, i.e. to control the payout by means of a control code and to supervise the payout by means of time control, can be carried out also by means of circuit arrangements of other types than described above without differing from the scope of protection defined by the enclosed claims, however.

What is claimed is:

1. A gaming device comprising a gaming machine (1), a payout machinery (2) controlled by the gaming machine (1) and driven by a direct voltage motor (M), the operating time of which machinery proportional to the size of the payouts is controlled by a control signal (4) produced by the gaming machine (1), and means (3) for feeding the motor (M) with drive current depending on the control signal (4) of the gaming machine (1), c h a r a c t e r i z e d in that the control signal (4) is a digital code of at least 2 bits and the means (3) for feeding the motor (M) with current comprise a control register (5) with an input receiving the control signal (4) and with an output (6), the state of which depends on the value of the control signal (4), a shift register (7) with an output (Q), a reset input (R) and a data input (D) receiving the output (6) of the control register, and a logic (8) for time control with a starting input (9) connected to the control register (5) and with an output (10) connected to the reset input (R) of the shift register (7) to reset the shift register output (Q) to zero after the control time set in the logic (8) for time control has expired, whereby the shift register (7) output (Q) comprises the drive current for the motor (M) of the payout machinery (2) either directly or through a current amplifier (11).

2. A gaming device according to claim 1, characterized in that the control register (5), the shift register (7) and the logic (8) for time control form an integrated circuit.

* * * * *